US006824454B2

(12) United States Patent
Kimura et al.

(10) Patent No.: US 6,824,454 B2
(45) Date of Patent: Nov. 30, 2004

(54) POLISHING APPARATUS

(75) Inventors: Norio Kimura, Kanagawa-ken (JP); Tadakazu Sone, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 35 days.

(21) Appl. No.: 09/777,707

(22) Filed: Feb. 7, 2001

(65) Prior Publication Data

US 2001/0014574 A1 Aug. 16, 2001

(30) Foreign Application Priority Data

Feb. 7, 2000 (JP) ..... 2000-29008

(51) Int. Cl.[7] ..... B24B 7/00
(52) U.S. Cl. ..... 451/285; 451/444
(58) Field of Search ..... 451/72, 56, 443, 451/444, 285–289

(56) References Cited

U.S. PATENT DOCUMENTS 5,857,898 A * 1/1999 Hiyama et al.
6,033,290 A * 3/2000 Gurusamy et al. ..... 451/56
6,514,126 B1 * 2/2003 Vanell ..... 451/72
6,607,426 B2 * 8/2003 Suzuki ..... 451/56
6,609,962 B1 * 8/2003 Wakabayashi et al. ..... 451/443

FOREIGN PATENT DOCUMENTS

EP 0816017 1/1998

* cited by examiner

*Primary Examiner*—M. Rachuba
(74) *Attorney, Agent, or Firm*—Wenderoth, Lind & Ponack, L.L.P.

(57) ABSTRACT

A polishing apparatus for polishing a substrate comprises a turntable having a polishing surface, a substrate holder for holding a substrate and bringing the substrate into contact under pressure with the polishing surface, a dresser including a dresser tool adapted to be brought into contact under a pressure with the polishing surface to dress or condition the polishing surface and a pressure device connected to the dresser for moving the dresser between a raised position where the dresser is spaced away from the polishing surface and a dressing position where the dresser rests on the polishing surface such that the dresser tool is in contact with the polishing surface under a pressure exerted by the weight of the dresser itself, the pressure device including a member for applying an upward force to the dresser to decrease the pressure.

12 Claims, 4 Drawing Sheets

POLISHING APPARATUS

BACKGROUND OF THE INVENTION

The present invention relates to a polishing apparatus for polishing a substrate, such as a semiconductor wafer. Specifically, the present invention relates to a polishing apparatus including a novel dresser device. The dresser device is used for regeneration (dressing or conditioning) of a polishing surface of a polishing pad or a polishing plate comprising abrasive particles.

A conventional polishing apparatus of the above-mentioned type is shown in FIG. 1. In FIG. 1, the polishing apparatus comprises a turntable 1 having a polishing pad 2 covering an upper surface thereof and a substrate holder 3 for holding a substrate (not shown) to be polished, such as a semiconductor wafer. A substrate is held on a lower side of the substrate holder 3 and is pressed against a polishing surface of the polishing pad 2 on the turntable 1. While pressing the substrate against the polishing surface, an abrasive liquid is supplied onto the polishing surface, and relative movement between the polishing pad 2 and the substrate is conducted by rotating the turntable 1 in a direction indicated by an arrow A and rotating the substrate holder 3 in a direction indicated by an arrow B. Thus, the substrate is polished to a flat and mirror-finished surface. It should be noted that a polishing plate comprising abrasive particles may be used, instead of the polishing pad 2.

In this apparatus, the polishing surface of the polishing pad 2 becomes clogged after polishing of a plurality of substrates, to thereby lower an efficiency of polishing. Therefore, when a predetermined number of substrates have been polished or the efficiency of polishing has been lowered due to clogging, the polishing surface is scraped for dressing, by means of a dresser 4.

The dresser 4 comprises a dresser tool 5 and a dresser shaft 6 for supporting the dresser tool 5. The dresser shaft 6 is adapted to be rotated by means of a rotary mechanism (not shown) in a direction indicated by an arrow C. The dresser tool 5 is adapted to be pressed against the polishing pad 2 by means of an air cylinder 7 and the dresser shaft 6. An annular projection 5*a* is formed on a lower surface of the dresser tool 5. The annular projection 5*a* is formed from a member (such as a diamond pellet) containing diamond particles or a hard material such as a ceramic material. A relative movement between the dresser tool 5 and the polishing pad 2 is conducted by rotating the dresser shaft 6 and the turntable 1, to thereby scrape the polishing surface of the polishing pad 2 for dressing.

For effecting dressing of the polishing surface of the polishing pad 2, air is supplied through the controller 8 to the air cylinder 7, so as to press the dresser tool 5 against the polishing pad 2 under a predetermined pressure. Therefore, the minimum pressure applied to the polishing pad 2 (the pressure when no air is supplied through the controller 8 to the air cylinder 7) is equal to the total of the weight of the dresser tool 5 and the weight of the dresser shaft 6.

During dressing, as shown in FIG. 2, the rate (mm/hr) of scraping of the polishing pad 2 is proportional to the pressure applied to the polishing pad 2. Generally, the total of the weight of the dresser tool 5 and the weight of the dresser shaft 6 is about 10 kg, so that it is impossible to reduce the pressure applied to the polishing pad to less than 100 N (Newton). Therefore, the polishing pad 2 is scraped at a high rate, leading to a rapid wear of the polishing pad 2.

SUMMARY OF THE INVENTION

In view of the above, the present invention has been made. It is an object of the present invention to provide a polishing apparatus for polishing a substrate comprising a turntable having a polishing surface, a substrate holder for holding a substrate and bringing the substrate into contact under a pressure with the polishing surface to polish the substrate, a dresser including a dresser tool adapted to be brought into contact under pressure with the polishing surface to dress or condition the polishing surface and a pressure device connected to the dresser tool for moving the dresser between a raised position where the dresser is spaced away from the polishing surface and a dressing position where the dresser rests on the polishing surface such that the dresser tool is in contact with the polishing surface under a pressure exerted by the weight of the dresser itself. The pressure device includes a member for applying an upward force to the dresser to decrease the pressure and a downward force to the dresser to increase the pressure.

By this arrangement, the pressure between the dresser tool and the polishing surface of the turntable can be adjusted to a level less than that generated by the weight of the dresser itself. Therefore, dressing of the polishing surface can be conducted while suppressing a rapid wear of the polishing surface.

The dresser may comprise a dresser shaft connected to the dresser tool and extending upward vertically from the dresser tool and the pressure device may comprise a cylinder equipped with a piston to which the dresser shaft is connected. A kinetic frictional resistance against movement of the piston in the cylinder is preferably 0.5 kg or less. First and second pressure supply devices may be fluidly connected to the cylinder so that the first pressure supply device supplies a pressurized fluid to the cylinder to apply an upward force to the piston and the second pressure supply device supplies a pressurized fluid to the cylinder to apply a downward force to the piston.

By preliminarily supplying a pressurized fluid to the above-mentioned cylinder so as to counter the weight of the dresser, the pressure between the dresser tool and the polishing surface of the turntable can be easily minimized to a level less than the weight of the dresser and adjusted to an arbitrary value exceeding that level (for example, a value in a range of 10 N to 300 N).

In accordance with another aspect of the present invention, there is provided a polishing apparatus comprising a turntable having a polishing surface, a substrate holder for holding a substrate and bringing the substrate into contact under pressure with the polishing surface, a dresser tool adapted to be brought into contact under pressure with the polishing surface to dress or condition the polishing surface, and a dresser tool holding device for holding the dresser tool and moving the dresser tool between a raised position where the dresser tool is spaced away from the polishing surface and a dressing position where the dresser tool rests on the polishing surface with a pressure being exerted by the dresser tool on the polishing surface by the weight of the dresser tool itself.

By this arrangement, there is no possibility that a pressure exceeding the weight of the dresser tool will be applied to the polishing surface. Therefore, dressing of the polishing surface can be conducted while suppressing a rapid wear of the polishing pad or plate.

The dresser tool holding device may support the dresser tool in such a manner that the dresser tool is substantially freely movable in a vertical direction relative to the dresser tool holding device.

The dresser tool holding device may comprise an air cylinder equipped with a piston connected to the dresser tool to move the dresser tool between the raised position and the dressing position, and there may be provided a shaft extending vertically and having a lower end connected to the dresser tool and an upper end connected to the piston. The dresser tool may be freely movable in a vertical direction relative to the lower end of the shaft. The shaft may be provided at its lower end with a flange extending radially outwardly from the lower end and having vertical through holes formed therein and the dresser tool may be provides with a plurality of vertical connecting pins extending through the through holes of the flange. Each of the connecting pins may be provided with a head adapted to be engaged with an upper surface of the flange when the dresser tool is positioned at the raised position. There may be provided an automatic aligning roller bearing connected between the flange and the dresser tool so that the dresser tool can tilt in compliance with undulations on the polishing surface.

The foregoing and other objects, features and advantages of the present invention will be apparent from the following detailed description and appended claims taken in connection with the accompanying drawings.

DETAILED DESCRIPTION OF THE INVENTION

Figure 1:
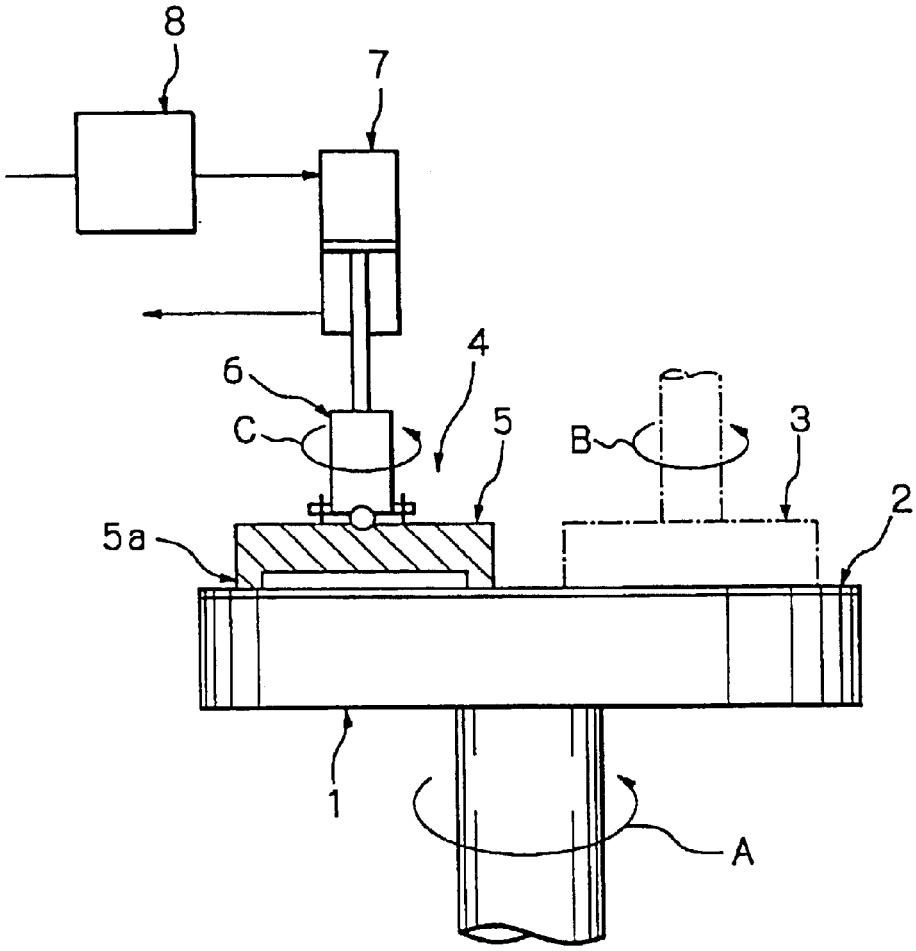
Fig. 1 (PRIOR ART)
FIG. 1 shows an example of a general arrangement of a conventional polishing apparatus.
Figure 2:
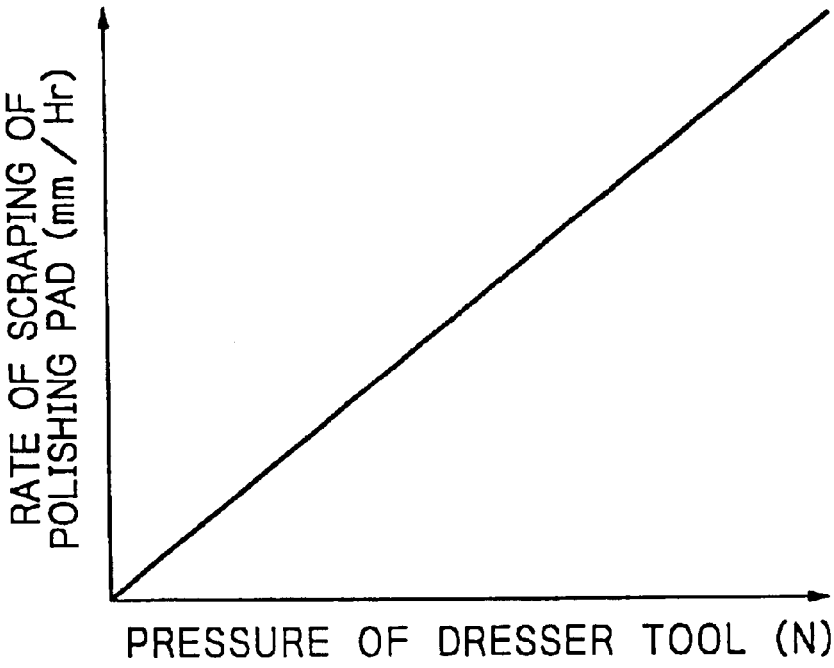
Fig. 2 (PRIOR ART)
FIG. 2 is a graph showing a relationship between the pressure of a dresser tool and the rate of scraping of a polishing pad.
Figure 3:
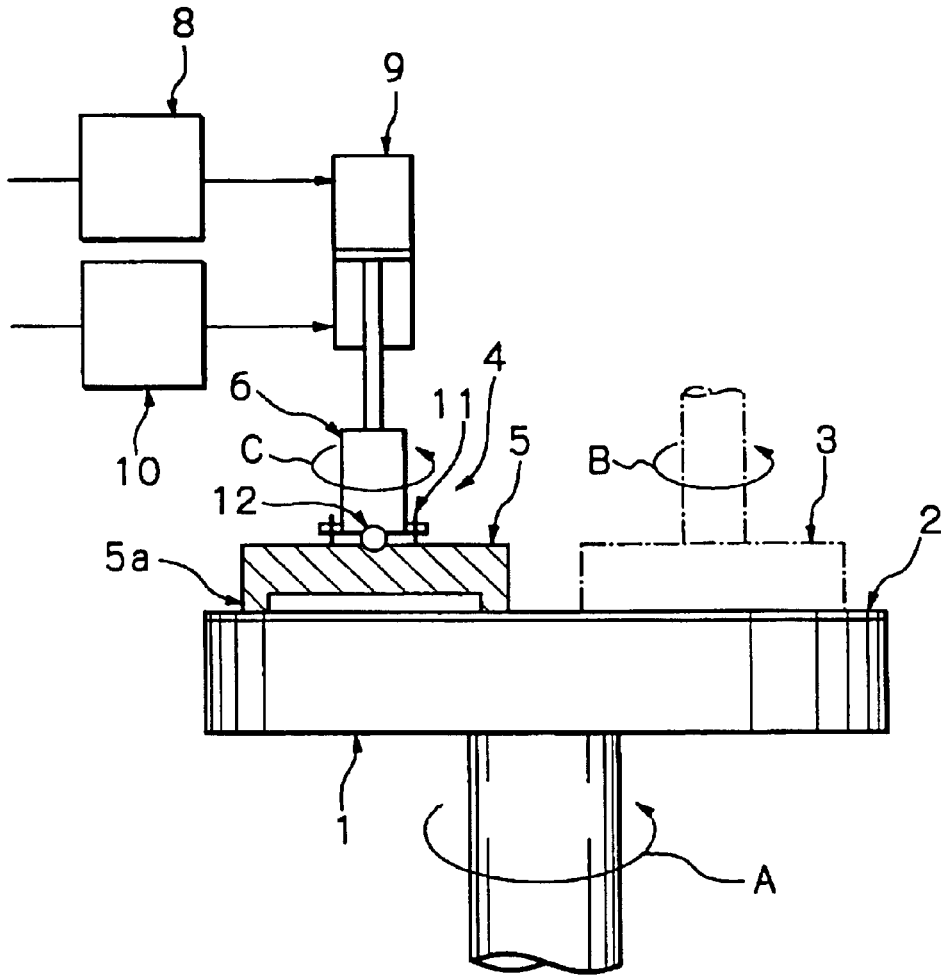
FIG. 3 is a view showing an example of a general arrangement of a polishing apparatus in accordance with an embodiment of the present invention.
Figure 4:
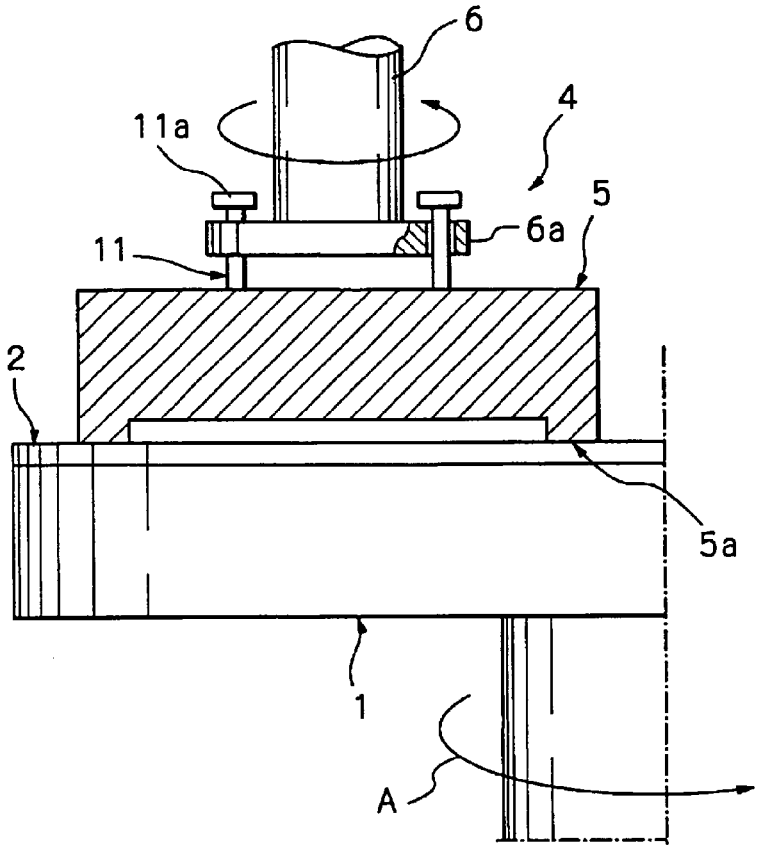
FIG. 4 is a sectional view showing a dresser of a polishing apparatus in accordance with another embodiment of the present invention.
Figure 5:
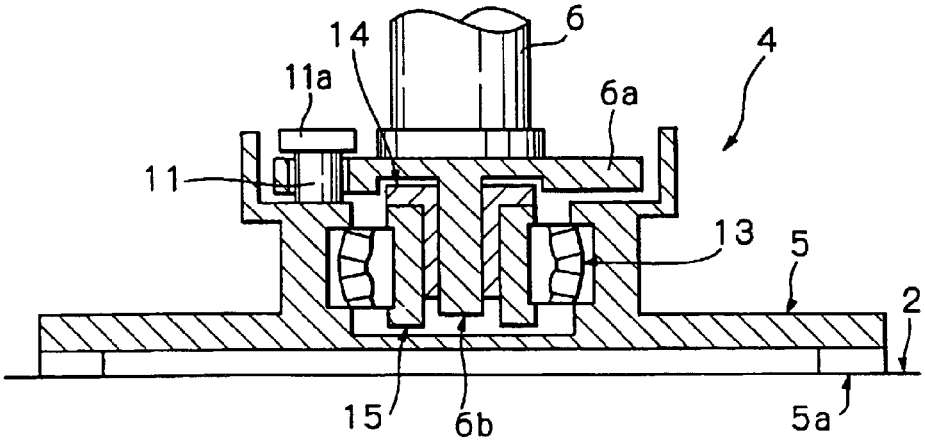
FIG. 5 is a sectional view showing a dresser of a polishing apparatus in accordance with a further embodiment of the present invention.

Hereinbelow, description is made with regard to embodiments of the present invention, with reference to FIGS. 3 to 5. In FIGS. 3 through 5, the same portions as those in FIG. 1 or the portions corresponding to those in FIG. 1 are designated by the same reference numerals as used in FIG. 1.

FIG. 3 is a view showing an example of a general arrangement of a polishing apparatus of the present invention.

The polishing apparatus includes a turntable 1 with a polishing pad 2 provided on the upper side of the turntable 1, a substrate holder or wafer carrier 3, a dresser 4 and an air cylinder 9 for urging the dresser 4 against the polishing pad 2.

The air cylinder 9 is a low-friction type and the kinetic frictional resistance generated when a piston in the air cylinder 9 is moved is about 0.44 kg or less. Air is supplied through the controller 8 to the air cylinder 9 in a direction for moving the dresser 4 in a downward direction (a direction for pressing the polishing pad 2) and is supplied through a regulator 10 to the air cylinder 9 in a direction for moving the dresser 4 in an upward direction (a direction for countering the weight of the dresser).

In this polishing apparatus, the weight of the dresser tool 5 and the weight of the dresser shaft 6 are set in the regulator 10 and air is preliminary supplied through the regulator 10 to the air cylinder 9 in an amount sufficient for countering the weight of the dresser 4. Therefore, when no air is supplied through the controller 8 to the air cylinder 9, the pressure applied to the polishing pad 2 is zero. Consequently, by adjusting the amount of air supplied through the controller 8 to the air cylinder 9, the pressure applied to the polishing pad 2 can be adjusted to an arbitrary value between zero and a value larger than zero. That is, the pressure of the dresser tool 5 applied to the polishing surface of the polishing pad 2 can be minimized to a level less than the weight of the dresser tool 5 and can be adjusted to an arbitrary value exceeding that level.

As is described above, by supplying air through the regulator 10 to the air cylinder 9 in a direction opposite to the direction of air supplied through the controller 8, the weight of the dresser 4 is countered. In this case, however, the air cylinder 7 of a conventional type shown in FIG. 1 has a problem such that when the pressure applied to the polishing pad 2 is set to be low by the controller 8, it is difficult for an actual pressure applied to the polishing pad 2 to be precisely controlled due to a frictional resistance (slide resistance) of the air cylinder. This problem can be avoided by using the air cylinder 9 of a low-friction type having a frictional resistance of about 0.44 kg or less. By this arrangement, the minimum pressure applied to the polishing pad 2 can be set to a level as low as, for example, 10 N (Newton).

In FIG. 3, reference numeral 11 denotes a torque transmitting pin for transmitting a torque of the dresser shaft 6 to the dresser tool 5. Reference numeral 12 denotes a ball bearing for supporting the dresser tool 5 relative to the dresser shaft 6 in a manner enabling the dresser tool 5 to be inclined relative to the dresser shaft 6.

FIG. 4 shows a polishing apparatus in accordance with another embodiment of the present invention.

In this embodiment, a dresser tool 5 is connected to a dresser shaft 6 by torque transmission pins 11 in such a manner that the dresser tool 5 is movable relative to the dresser shaft 6 in a vertical direction, while the dresser tool 5 is rotated together with the dresser shaft 6. As shown, each torque transmission pin 11 extends through a vertical through hole formed in a flange 6*a* fixedly connected to the lower end of the dresser shaft 6 with a clearance being provided between the outer surface of the pin 11 and the inner surface of the vertical through hole of the flange 6*a*. The torque transmission pin 11 is provided at its upper end with a large diameter head 11*a*.

When the dresser shaft 6 is located at an elevated position, a lower surface of the pin head 11*a* is engaged with an upper surface of the flange 6*a* of the dresser shaft 6, whereby the dresser tool 5 is supported by the dresser shaft 6 in a suspended fashion.

To effect dressing, the dresser 4 is moved to a dressing position above the polishing surface of the polishing pad 2. When the dresser shaft 6 is lowered at this position, a lower surface of the dresser tool 5 is brought into contact with the polishing surface of the polishing pad 2. Then, the dresser shaft 6 is further lowered (in a range such that there is no contact between a lower surface of the flange 6*a* and an upper surface of the dresser tool 5), to thereby enable the dresser tool 5 to rest under its own weight on the polishing surface.

As mentioned above, during dressing, the dresser tool 5 is disconnected from the dresser shaft 6 in a vertical direction and rests on the polishing surface of the polishing pad 2 under its own weight. Consequently, the dresser tool 5 is pressed against the polishing pad 2 under a low pressure equal to its own weight, whereby rapid wear of the polishing pad during dressing can be avoided.

FIG. 5 shows a dresser 4 of a polishing apparatus in accordance with a third embodiment of the present invention. In this dresser 4, the dresser tool 5 is supported relative to a bearing support member 15 through an automatic aligning roller bearing 13, in a manner enabling the dresser tool 5 to be inclined relative to the bearing support member 15. The bearing support member 15 is provided with a slide member 14 which enables the support member 14 to vertically move along a guide pin 6*b*, which extends downwards from a flange 6*a* formed integrally with a lower end of a dresser shaft 6. When the dresser shaft 6 is located at an elevated position, the lower surface of the head 11*a* of the torque transmission pin 11 is engaged with the upper surface of the flange 6*a* of the dresser shaft 6 so that the dresser tool 5 is suspended from the dresser shaft 6. This is the same as in the case of the dresser 4 in FIG. 4.

Even when the polishing surface of the polishing pad 2 is inclined, the automatic aligning roller bearing 13 enables the dresser tool 5 to follow the inclined polishing surface and dressing is conducted under a pressure equal to the weight of the dresser tool 5. Therefore, a rapid wear of the polishing during dressing can be avoided.

In the above-mentioned embodiments, a polishing apparatus in which a polishing pad is provided on a turntable is taken as an example. However, this does not limit the present invention. A polishing apparatus in which a polishing plate comprising abrasive particles (an abrasive plate) is provided on the turntable may be used.

What is claimed is:

1. A polishing apparatus for polishing a substrate comprising:

a turntable having a polishing surface;

a substrate holder for holding a substrate and bringing the substrate into contact under pressure with said polishing surface;

a dresser including a dresser tool adapted to be brought into contact under a pressure with said polishing surface to dress or condition said polishing surface; and a pressure device connected to said dresser for moving said dresser between a raised position where said dresser is spaced away from said polishing surface and a dressing position where said dresser rests on said polishing surface such that said dresser tool is in contact with said polishing surface under only a pressure exerted by the weight of said dresser tool, said pressure device including a member for applying an upward force to said dresser to decrease the pressure during a dressing operation, wherein said dresser further comprises a dresser shaft connected to said dresser tool and extending upward vertically from the dresser tool, and said pressure device comprises a cylinder equipped with a piston to which said dresser shaft is connected, and wherein a kinetic frictional resistance against movement of said piston in said cylinder is 0.5 kg or less.

2. A polishing apparatus as set forth in claim 1, wherein there are provided first and second pressure supply devices fluidly connected to said cylinder so that said first pressure supply device supplies a pressurized fluid to said cylinder to apply said upward force to said piston and said second pressure supply device supplies a pressurized fluid to said cylinder to apply said downward force to said piston.

3. A polishing apparatus comprising:

a turntable having a polishing surface;

a substrate holder for holding a substrate and bringing the substrate into contact under pressure with said polishing surface;

a dresser tool adapted to be brought into contact under pressure with said polishing surface to dress or condition said polishing surface; and a dresser tool holding device for holding said dresser tool and moving said dresser tool between a raised position where said dresser tool is spaced away from said polishing surface and a dressing position where said dresser tool rests on said polishing surface with a pressure being exerted by said dresser tool on said polishing surface as a result of the sole weight of said dresser tool, wherein said dresser tool holding device supports said dresser tool in such a manner that the dresser tool is substantially freely movable in a vertical direction relative to said dresser holding device, wherein said dresser tool holding device comprises an air cylinder equipped with a piston connected to said dresser tool to move said dresser tool between said raised position and said dressing position, there being provided a shaft extending vertically and having a lower end connected to said dresser tool and an upper end connected to said piston, and wherein said dresser tool is freely movable in a vertical direction relative to said lower end of said shaft.

4. A polishing apparatus as set forth in claim 3, wherein said dresser shaft is provided at its lower end with a flange extending radially outwardly from the lower end and having vertical through holes formed therein and said dresser tool is provided with a plurality of vertical connecting pins extending through said through holes of said flange.

5. A polishing apparatus as set forth in claim 4, wherein each of said connection pins is provided with a head adapted to be engaged with an upper surface of said flange when said dresser tool is positioned at said raised position.

6. A polishing apparatus as set forth in claim 5, where there is provided an automatic aligning roller bearing connected between said flange and said dresser tool to enable the dresser tool to tilt in response to undulations on said polishing surface.

7. A polishing apparatus comprising:

a turntable having a polishing surface;

a substrate holder for holding a substrate and bringing the substrate into contact under pressure with said polishing surface;

a dresser tool adapted to be brought into contact under pressure with said polishing surface to dress or condition said polishing surface; and a dresser tool holding device for holding said dresser tool and moving said dresser tool between a raised position where said dresser tool is spaced away from said polishing surface and a dressing position where said dresser tool rests on said polishing surface with a pressure being exerted by said dresser tool on said polishing surface as a result of the sole weight of said dresser tool, wherein said dresser tool holding device comprises a dresser shaft, and wherein said dresser tool and said dresser shaft are arranged so as to be movable toward and away from each other during a dressing operation.

8. A polishing apparatus according to claim 7, wherein said dresser shaft is connected to said dresser tool by a torque transmission pin for transmitting rotational torque from said dresser shaft to said dresser tool.

9. A polishing apparatus according to claim 8, wherein said dresser shaft comprises a flange, and said torque transmission pin is extended through said flange.

10. A polishing apparatus according to claim 7, further comprising a bearing for supporting said dresser tool relative to said dresser shaft in a manner enabling said dresser tool to be inclined relative to said dresser shaft.

11. A polishing apparatus according to claim 10, wherein said bearing comprises a ball bearing.

12. A polishing apparatus according to claim 10, wherein said bearing comprises a roller bearing.

* * * * *